United States Patent [19]

Langstroth

[11] 3,997,080

[45] Dec. 14, 1976

[54] PRESSURIZED LIQUID MIXER AND DISPENSER SYSTEM

[75] Inventor: Hall Langstroth, Coral Gables, Fla.

[73] Assignee: Watsco, Inc., Hialeah, Fla.

[22] Filed: Nov. 20, 1975

[21] Appl. No.: 633,619

[52] U.S. Cl. ..... 222/61; 222/63; 222/135

[51] Int. Cl.[2] ..... B67D 5/08

[58] Field of Search ..... 222/61, 63, 135, 136, 222/129; 259/4

[56] References Cited

UNITED STATES PATENTS

| | | | |
|---|---|---|---|
| 3,140,011 | 7/1964 | Powers et al. | 222/133 X |
| 3,760,982 | 9/1973 | Haase | 222/63 |
| 3,804,299 | 4/1974 | Kain | 222/61 |
| 3,910,462 | 10/1975 | Abeles et al. | 222/135 |

*Primary Examiner*—Allen N. Knowles
*Attorney, Agent, or Firm*—Ernest H. Schmidt

[57] ABSTRACT

A pressurized mixer and dispenser system for liquid shampoo and the like hair treating fluids wherein an electric pump is used to withdraw liquid concentrate directly from its supply container for admixing with pressurized tap water in a mixing chamber utilizing both jet stream interaction and filtering through a baffle element of a plastic mesh to achieve intimate mixing as diluted concentrate is drawn from the system by the use of one or more associated station dispensing guns, either singly or in simultaneous use, without the need of a mixed concentrate holding tank.

10 Claims, 8 Drawing Figures

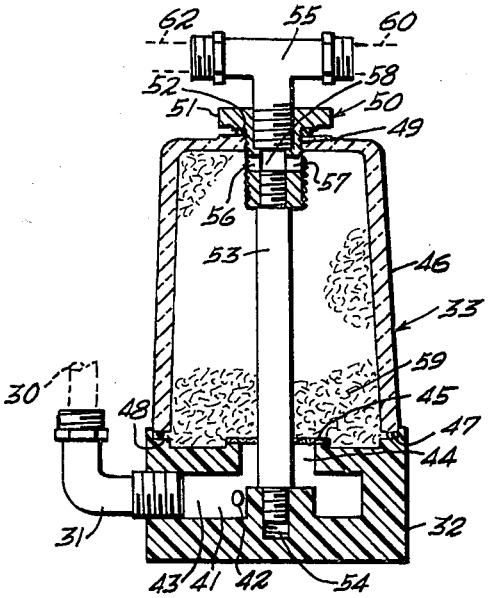
Fig. 6
Fig. 7
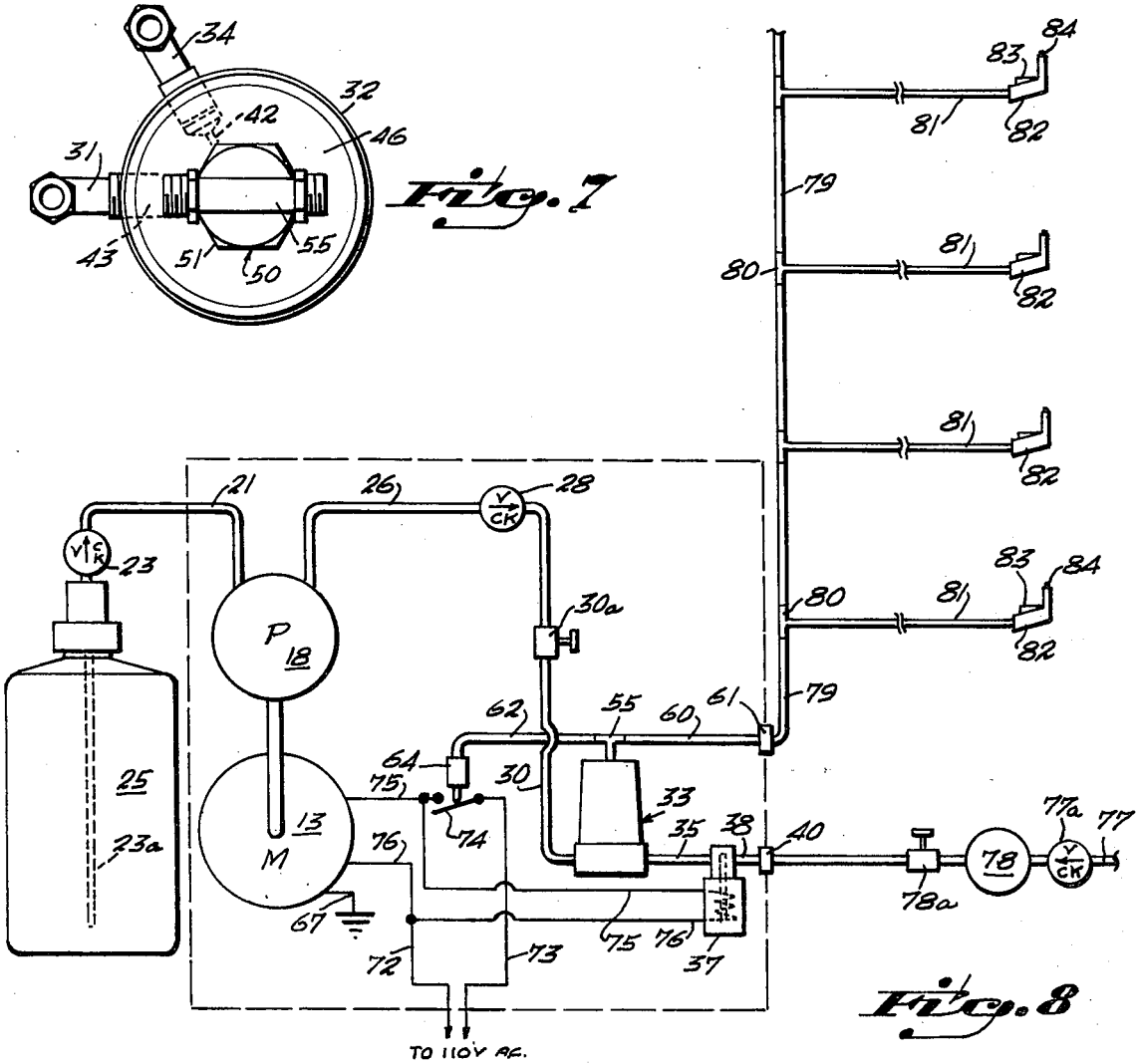
Fig. 8

PRESSURIZED LIQUID MIXER AND DISPENSER SYSTEM

This invention relates to devices for mixing a fluid concentrate with water or another diluent for the selective dispensing for use at a plurality of operator stations in beauty salons and the like of fluid hair treating preparations such as shampoos. The invention is directed particularly to a pressurized mixer and dispenser system for mixing liquid soap concentrate with pressurized tap water for dispensing diluted concentrate as a liquid shampoo, selectively, through one or more of a plurality of dispensing gun nozzles at the work stations in a beauty salon having a plurality of operator hair treatment stations.

Various systems have heretofore been devised for mixing liquid concentrates, such as shampoo concentrates, with water for dispensing in proper proportion for use as a liquid shampoo. Such devices as have heretofore been devised, however, are deficient in various respects, principally in that to force the concentrate from its container for the mixing operation, air or water pressure has commonly been used. In the interests of economy and simplicity such air pressure, for example, was applied directly to the supply container of liquid concentrate through a special screw-cap fitting to force the concentrate outwardly of a dip tube extending to the bottom of the container for mixing with the diluent in a mixing chamber. The additional imposition of such internal pressures on concentrate containers, however, not infrequently resulted in their expansion, leakage and even breakage, so that either stronger and heavier concentrate containers were required, or separate concentrate holding tanks were designed as part of the mixing system into which the concentrate had to be poured from its delivery container. Other deficiencies in prior systems resided in their inability to intimately mix the shampoo concentrate and water without the use of mixture holding tanks and the like, so that properly diluted liquid shampoo would always be available for dispensing at any one of the salon operator stations.

The principal object of this invention is to provide a novel and improved pressurized liquid mixer dispensing system of the character described that obviates the above described deficiencies of prior systems.

A more particular object of the invention is to provide a pressurized mixer and dispenser systems for liquid shampoo and the like hair treating fluids wherein an electric pump is used to withdraw the liquid concentrate directly from its supply container for admixing with pressurized tap water in a mixing chamber utilizing both jet stream interaction and filtering through a baffle element of a plastic mesh to achieve intimate mixing as diluted concentrate is drawn from the system by the use of one or more of the associated station dispensing guns, either singly or in simultaneous use, without the need of a mixed concentrate holding tank.

Another object of the invention is to provide a pressurized mixer and dispenser system of the above nature wherein energization of the concentrate pressurizing pump is automatically controlled by actuation for dispensing of any one of the concentrate mixture dispensing guns effecting a reduction in line pressure below a predetermined minimal valve.

Another object is to provide a pressurized mixer dispensing system of the character described including means controlled by the de-energization or shut-off of the concentrate flow pump for simultaneously shutting off the supply of admixture water to the mixing chamber to prevent water alone from being fed to the mixing chamber.

Yet another object of the invention is to provide a pressurized liquid mixer and dispenser system which will be simple in construction, inexpensive to manufacture, compact, attractive in appearance, and foolproof, dependable and long wearing in operation.

Other objects, features and advantages of the invention will be apparent from the following description when read with reference to the accompanying drawings. In the drawings, where like reference numerals denote corresponding parts throughout the several views:

FIG. 6 is a vertical cross-sectional view of the concentrate and water mixing device, shown separately and in an enlarged scale;

FIG. 7 is a top view of the mixing device illustrated in FIG. 6; and

FIG. 8 is a schematic diagram of the entire system.

Figure 1:
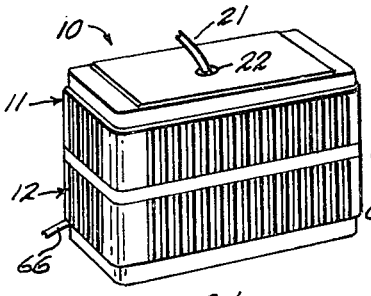
FIG. 1 illustrates, in perspective, the housing assembly containing the various pumping, mixing and flow control components comprising the system.

Referring now in detail to the drawings, reference numeral 10 in FIG. 1 indicates, generally, the housing containing the system components exclusive of the shampoo concentrate supply container, the water inlet conduit and pressure regulator, and the mixture flow line associated with multiple shampoo dispensing guns. The housing 10 comprises substantially identical upper and lower housing halves 11, 12, respectively, which are preferably molded of a tough synthetic plastic material and which are retained in interassembled relation by screw means hereinafter described.

Figure 2:
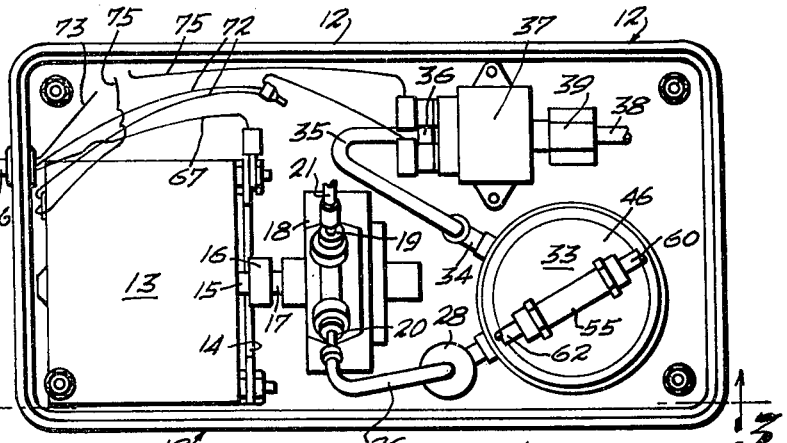
FIG. 2 is a comparatively large plan view of the bottom half of the component housing, shown separately and illustrating the disposition of the various components therein.
Figure 3:
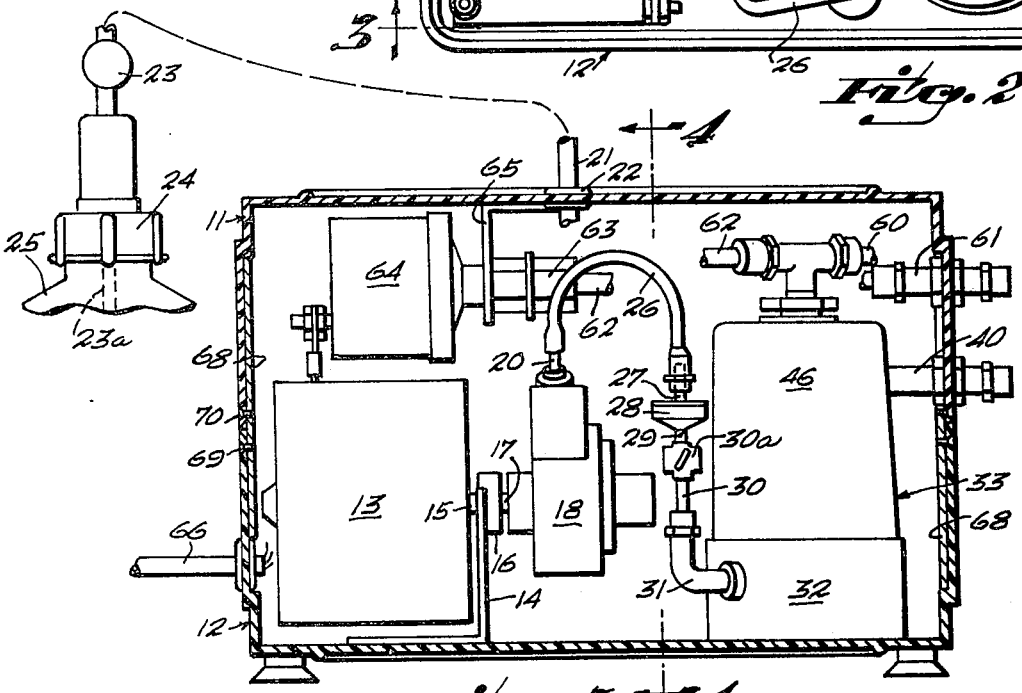
FIG. 3 is a vertical cross-sectional view taken along the line 3—3 of FIG. 2 in the direction of the arrows and illustrating details of the interior of both top and bottom halves of the housing structure when assembled as in FIG. 1.

As best illustrated in FIGS. 2 and 3, a fractional horsepower electric motor 13 secured within one corner of the lower housing half 12 as by right angular bracket 14 has its drive shaft 15 connected through flexible coupling 16 to the input shaft 17 of a rotary fluid concentrate pump 18 having a tubular inlet or suction port 19 and a tubular outlet or pressure port 20. A flexible conduit 21, such as of polyvinyl chloride tubing, communicates with the suction port 19 and extends through a rubber grommet 22 fitted within an opening in the top wall of the upper housing half 11 for connection, through check valve 23, with the dip tube **23*a* of a vented cap 24 supplied for use with a standard container of liquid concentrate 25.**

The pressure port 20 of the concentrate pump 18 interconnects through flexible conduit 26 with the inlet port 27 of a check valve 28, the outlet port 29 of which check valve communicates, through conduit 30 and needle valve 30*a*, with an inlet port fitting 31 of base portion 32 of a mixing unit 33. The base portion 32 of the mixing unit 33 is also provided with a second inlet port fitting 34 for the inflow of diluent tap water through flexible conduit 35 communicating therewith (see FIG. 2).

Figure 5:
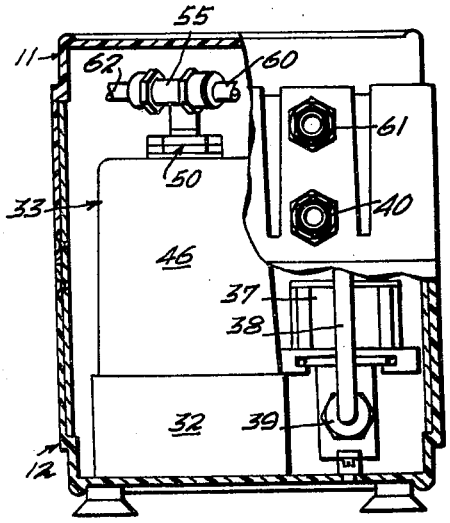
FIG. 5 is a right end elevational view of the housing assembly as illustrated in FIG. 4, with portions of the right wall broken away to reveal details of internal construction.

Means is provided for automatically controlling the flow of inlet diluent water to the mixing unit 33. To this end, the flexible inlet water conduit 35 is connected at its distal end with the outlet port 36 of a solenoid shut-off valve 37. A flexible conduit 38 interconnects the inlet fitting 39 of solenoid valve 37 with a feed-through fitting 40 extending through the right end wall of the upper housing half 11 (see FIGS. 3 and 5).

As illustrated in FIGS. 6 and 7, the first and second inlet port fittings 31, 34 communicate with an annular mixing chamber 41 formed in the base portion 32 of the mixing unit 33. As best seen in FIG. 7, the inlet opening of the second inlet port fitting 34 communicating with the annular mixing chamber 41 is of substantially reduced diameter, as indicated at 42, to provide for jet stream intermixing of the entering diluent water with the concentrate being pumped through the comparatively large diameter opening 43. The annular mixing chamber 41 communicates with a coaxial, reduced-diameter opening 44 against an upper marginal rim portion of which is seated annular wire-mesh strainer member 45. An inverted bowl 46, preferably of glass, seats against an O-ring 47 seated, in turn, within an annular, peripheral shoulder 48 provided at the upper end of the base portion 32 of the mixing unit 33. The upper end of the bowl 46 is formed with a central opening 49 through which a base nut 50 extends, said base nut being formed with a circular upper end portion 51 of increased diameter, the underside of which bears down against the upper end of bowl 46 through a sealing O-ring 52. The inwardly extending, reduced-diameter end of the base nut 50 is internally threaded to receive one end of a threaded assembly rod 53, the other end of which rod is threaded for reception within an internally threaded opening 54 provided at the center of the base portion 32.

The upper, outwardly extending end of the base nut 50 is internally threaded to receive, screw-threaded therein, a T-fitting 55. The reduced-diameter inner end portion of the base nut 50 is also provided with side openings 56, 57 communicating with a central axial opening 58 providing for the flow of liquid through said side openings in communication with the T-fitting 55. It will be understood that the just described mixing bowl assembly including the base nut 50 and the assembly rod 53 provides for assembly and disassembly of said bowl with respect to the base portion 32. An important feature of the mixing unit 33 resides in the provision, within the assembled bowl 46, of a compact filling of synthetic plastic mesh 59. Shampoo concentrate and diluent water entering and jet stream intermingling within the annular mixing chamber 41 achieves substantially uniform mixing, whereafter, upon this mixture being pressure fed through the reduced-diameter annular opening 44 and the annular wire-mesh screen 45, still further mixing will be effected. Thence, as the intermixed shampoo concentrate and diluent is pressure fed upwardly through the compacted plastic mesh 59, the voluminous baffling and churning action imparted to the mixture in its upward passage therethrough and into and through the side openings 56, 57 communicating with the T-fitting 55 insures completely uniform dilution of the shampoo concentrate passing into said T-fitting.

A flexible conduit 60 interconnects one branch of the T-fitting 55 with a feed-through fitting 61 extending through the right end wall of the upper housing half 11, above the water feed-through fitting 40 for interconnection with the external conduit supply to the individual shampoo dispensing stations, as hereinafter more particularly described.

Means is provided for automatically energizing the concentrate pressurizing pump motor 13 upon actuation for dispensing of any one of the concentrate mixture dispensing guns. To this end, the remaining branch of the T-fitting 55 is connected through flexible conduit 62 with the pressure port fitting 63 of a pressure-controlled electrical switch unit 64 affixed with respect to an inner top wall portion of the upper housing half 11 as by right angular bracket 65 (see FIGS. 3 and 4).

The pressure actuated switch is of such design as to open circuit its normally closed single-pole switch contacts at an applied pressure greater than approximately 15 lbs. per sq. inch, as is hereinafter more particularly described.

Figure 4:
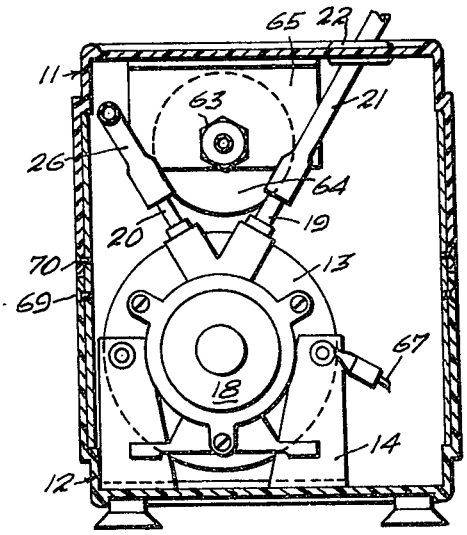
FIG. 4 is a vertical cross-sectional view taken on the transverse plane indicated along the line 4—4 of FIG. 3 in the direction of the arrows.

Energizing current for the electric motor 13, the solenoid shut-off valve 37 and the pressure-actuated switch unit 64 is supplied through a three-wire electrical cable 66 entering a left side wall portion of the lower housing half 12 near the lower end thereof. Current supoly will preferably be ordinary 110 volts a.c. household or commercial current, the third conductor 67 of the electrical cable 66 being a grounding conductor which, as illustrated in FIGS. 2 and 4, is connected to the ground frame of the electric motor 13 through the support bracket 14.

As means for assembling and disassembling the housing comprising the upper and lower housing halves 11, 12, there is provided at each end within the housing an aluminum insert plate 68 into which flat-head machine screws 69, 70 are threadingly received through chamfered openings extending through marginal end portions of the right and left side of said upper and lower housing halves. It will be understood that the above-described fluid conductors and electrical conductors will be of such length and arrangement within the assembled housing as to permit separation of the upper housing half 11 from the lower housing half 12 for convenient assembly, service and repair of the contained components whenever necessary.

Referring now to the schematic drawing of FIG. 8 and considering first the electrical circuitry, it will be seen that the electric motor 13 is energized through conductors 72, 73 from the source of AC supply, conductor 73 being in series with the single-pole electrical switch 74 of the pressure-actuated electrical switch unit 64. The energizing winding of the solenoid shut-off valve 37 is connected in parallel with the energizing circuit for the electric motor 13 through conductors 75, 76 so as to be actuated simultaneously with said motor upon closure of the switch 74 associated with the pressure-actuated electrical switch unit 64.

FIG. 8 further illustrates how utility or "tap" water under pressure from conduit 77 (partially illustrated) is fed to the water feed-through fitting 40 of the pressurized liquid mixer and dispenser system 10 through check valve 77*a*, pressure regulator 78, which serves to reduce inlet water pressure to approximately 15 lbs. per sq. inch, and needle valve 78*a*. FIG. 8 also illustrates how the shampoo mix is supplied through the feed-through fitting 61 to a flexible station supply main line 79 tapped along which, by means of T-fittings 80, are a plurality of station feed lines 81 terminating in liquid shampoo mix dispensing guns 82. Each of the dispensing guns 82 comprises a normally closed liquid flow valve controlled by a trigger 83 to release shampoo through a reduced flow diameter discharge orifice 84 at the front of the gun.

Considering now the operation of the system and assuming first that the solenoid shut-off valve 37 is open, its energized state, pressurized water from the water source fed through conduit 77 and pressurized concentrate pumped through concentrate pump 18 will pressurize the entire fluid system through the mixing unit 33. It will be understood that back pressure cannot be imposed upon concentrate pump 18 because of check valve 28 in outlet conduit 26. Assuming further that none of the dispensing guns 82 in the discharge system is being used, back pressure upon the pressure actuated electrical switch unit 64 will cause its associated switch 74 to open-circuit, thereby simultaneously de-energizing pump motor 13 and solenoid shut-off valve 37 and cutting off the input feed of both water and shampoo concentrate into the base portion 32 of the mixing unit 33. The system is now in readiness for use in dispensing diluted concentrate shampoo at any one or more of the dispensing gun stations. Whenever one or more of the dispensing guns 82 is actuated for the discharge of shampoo mix a drop in back pressure thereby effected at the pressure actuated electrical switch unit 64 serves to close its associated switch 74 so that both the concentrate pump 13 and the solenoid 37 become energized to supply water and shampoo concentrate under pressure to the base portion 32 of the mixing unit 33 wherein intimate intermixing or dilution of the concentrate takes place as described above. Thus, as long as there is demand for shampoo mix at any one of the dispensing stations served by shampoo dispensing guns 82, the energizing electrical switch 74 will be controlled to supply the required proportion of concentrate and water for mixing and dispensing through the nozzle orifices 84 of the dispensing guns 82.

The mix ratio of concentrate to water will be controlled by adjustment of the needle valves 30*a* and 78*a* in the respective concentrate and water feed lines entering the mixing unit 33. If a 10 to 1 mix of water diluent to concentrate is desired, this can readily be accomplished by appropriate relative adjustment of the needle valves 78*a* and 30*a*. These needle valves also serve to adjust the discharge volume of the mixture at the nozzles of the dispensing guns 82, as desired, over a wide range of discharge pressures. It is to be noted, however, that whatever their adjustment, the attenuation of flow through the mixing unit 33 afforded by the needle valves 78*a* and 30*a* insures enough of a drop in pressure in the mixture outlet conduit system including conduits 60, 62, 79 and 81 whenever one of the dispensing guns 82 is actuated for mixture discharge to provide for operation of the pressure actuated electrical switch unit 74 in the operation of the system as is hereinabove described.

The check valve 77*a* is provided as an anti-syphon device in the water inlet conduit 77 to prevent reverse flow contamination of the water supply system.

An important feature of the invention resides in the fact that the fluid concentrate is withdrawn from the concentrate container 25 by suction, with the upper end of the container vented, thereby imposing neither positive nor negative pressures within the container. For this reason, ordinary lightweight plastic concentrate containers normally used for commercial packaging and shipping can be used as the system supply containers.

Another advantage of the invention resides in the ability of the mixing unit 33 to achieve intimate intermixing and dilution of the concentrate with the water diluent as the fluids are pressure-fed therethrough, thereby eliminating any need for a holding tank or the like used as a storage device for fluid mixtures to be dispensed during dispensing operations.

While I have illustrated and described herein only one form in which my invention can conveniently be embodied in practice, it is to be understood that this form is presented by way of example only and not in a limiting sense. The invention, in brief, comprises all the embodiments and modifications coming within the scope and spirit of the following claims.

What I claim as new and desire to secure by Letters Patent is:

1. A pressurized liquid mixer and dispenser system for mixing a fluid concentrate supplied in a separate container with a diluent under pressure for intermittent dispensing of the diluted mixture comprising, in combination, a fluid pump having an inlet port and an outlet port, suction conduit means communicating with the inlet port of said fluid pump for withdrawing fluid concentrate from the fluid concentrate container, a fluid mixing unit having a first inlet mixing chamber at one end, a second mixing chamber communicating at one end with said first mixing chamber and an outlet port communicating with the other end of said second chamber, conduit means communicating between the outlet port of said fluid pump and said first inlet mixing chamber of said mixing unit, diluent supply conduit means for supplying diluent fluid under pressure to said first inlet mixing chamber of said mixing unit for mixing therein with fluid concentrate pumped by said fluid pump, a mixture supply conduit communicating with said outlet port of said mixing unit, a manually controllable, normally closed mixture discharge valve communicating with said mixture supply conduit for the dispensing for use of concentrate and diluent mixture flowing through said mixing unit, drive means for said fluid pump, and means controlled by a drop in pressure in said mixture supply conduit below a predetermined value upon actuation of said discharge valve for actuating said drive means for operation of said fluid pump.

2. A pressurized liquid mixer and dispenser system as defined in claim 1 including a normally closed shut-off valve in said diluent supply conduit means, said shut-off valve being controlled by the actuation of said pump drive means for simultaneously opening said shut-off valve upon said drop in pressure in said mixture supply conduit falling below said predetermined value.

3. A pressurized liquid mixer and dispenser system as defined in claim 2, including baffle means in said second mixing chamber for intimately intermixing said fluid concentrate and fluid diluent upon their passage therethrough to said outlet port of said mixing unit.

4. A pressurized liquid mixer and dispenser system as defined in claim 3, wherein said baffle means comprises a filling of synthetic plastic mesh within said second mixing unit chamber.

5. A pressurized liquid mixer and dispenser system as defined in claim 4, wherein said first inlet mixing chamber of said mixing unit is of annular configuration and wherein said diluent conduit means comprises a reduced diameter opening into said first inlet mixing chamber as compared with a circular opening in said first inlet mixing chamber comprising said conduit means communicating between said outlet port of said fluid pump and said first inlet mixing chamber of said mixing unit.

6. A pressurized liquid mixer and dispenser system as defined in claim 2 wherein said drive means comprises an electric motor, wherein said fluid pump is a rotary pump, and including coupling means between the drive shaft of the electric motor and the driven shaft of said rotary pump, an electrical energization circuit for said electric motor, wherein said pressure drop control means comprises a pressure-controlled electrical switch member in series with said energization circuit, and wherein said normally closed shut-off valve in said diluent conduit means comprises a solenoid controlled valve having an energization coil connected in parallel with the electrical input circuitry of said electric drive motor.

7. A pressurized liquid mixer and dispenser system as defined in claim 6, including baffle means in said second mixing chamber for intimately intermixing said fluid concentrate and fluid diluent upon their passage therethrough to said outlet port of said mixing unit.

8. A pressurized liquid mixer and dispenser system as defined in claim 7, wherein said baffle means comprises a filling of synthetic plastic mesh within said second mixing unit chamber.

9. A pressurized liquid mixer and dispenser system as defined in claim 8 including adjustable flow rate control means in both said conduit means communicating between said fluid pump outlet port and said first inlet mixing chamber, and said diluent supply conduit means, for controlling the mix ratio of concentrate and diluent.

10. A pressurized liquid mixer and dispenser system as defined in claim 9 including a plurality of said manually controllable, normally closed mixture discharge valves communicating with said mixture supply conduit for selective use in the dispensing of the concentrate mixture.

* * * * *